United States Patent [19]

Ruegg

[11] Patent Number: 4,548,059

[45] Date of Patent: Oct. 22, 1985

[54] PLUG TYPE LOCK FOR BRIEFCASES

[75] Inventor: Heinz Ruegg, Würenlos, Switzerland

[73] Assignee: Huber Italia S.R.L., Valmadrera, Italy

[21] Appl. No.: 536,910

[22] Filed: Sep. 28, 1983

[30] Foreign Application Priority Data

Oct. 8, 1982 [IT] Italy ..... 9551/82[U]

[51] Int. Cl.[4] ..... E05B 65/50

[52] U.S. Cl. ..... 70/69; 70/75; 292/281

[58] Field of Search ..... 70/2–4, 70/69–75, 454; 40/582, 583; 292/281, 283, 285

[56] References Cited

U.S. PATENT DOCUMENTS

| | | | |
|---|---|---|---|
| 4,100,775 | 7/1978 | Bako | 70/3 |
| 4,342,128 | 8/1982 | Doyle | 40/582 X |

FOREIGN PATENT DOCUMENTS

| | | | |
|---|---|---|---|
| 236052 | 10/1964 | Austria | 70/69 |
| 1428505 | 11/1968 | Fed. Rep. of Germany | 70/74 |
| 1537634 | 7/1968 | France | 70/69 |
| 582814 | 10/1958 | Italy | 70/69 |
| 353274 | 5/1961 | Switzerland | 70/74 |

*Primary Examiner*—Gary L. Smith
*Assistant Examiner*—Lloyd A. Gall
*Attorney, Agent, or Firm*—Collard, Roe & Galgano

[57] ABSTRACT

There is provided a combination plug type lock for briefcases, purses and the like wherein the upper portion is disposed on the flap of a briefcase and includes an outwardly-biased element, the lower portion is disposed on the corresponding opposite part of the briefcase and includes a shackle which slidingly receives the upper portion and engages the outwardly-biased element during closure of the lock, and wherein a locking mechanism is disposed in the upper portion in the region of the outwardly-biased element.

4 Claims, 5 Drawing Figures

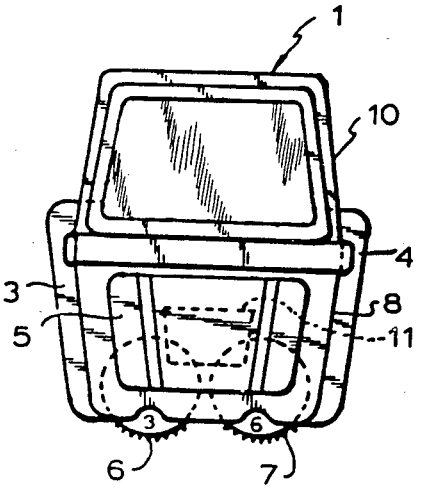
FIG. 1
FIG. 2
FIG. 3
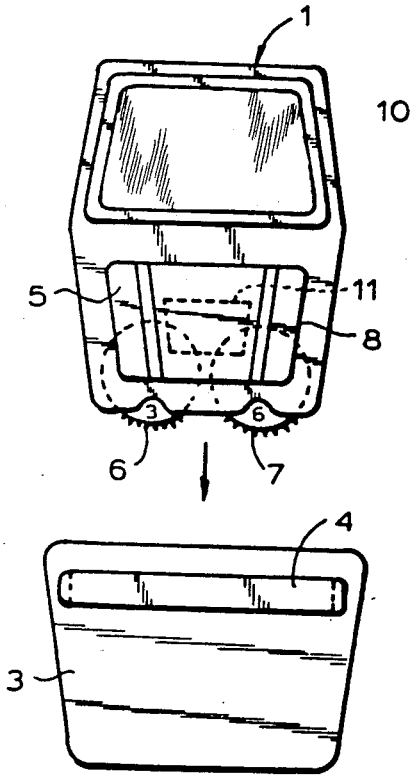
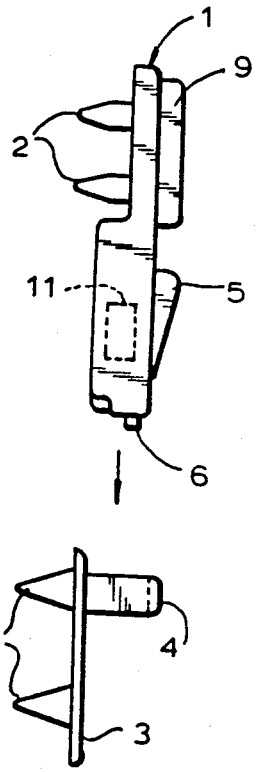
FIG. 4
FIG. 5

PLUG TYPE LOCK FOR BRIEFCASES

The present invention relates to a plug type lock for briefcases, purses, etc.

Known plug type locks for briefcases, purses, etc. consist generally of an upper portion attached, for example, to a flap of a briefcase, having an outwardly-biased, spring-loaded element and a lower portion disposed on a corresponding opposite part of the briefcase which includes a shackle. When the flap of the briefcase is closed, the upper portion of the lock is slidingly received in the shackle of the lower portion so that the outwardly-biased, spring-loaded element, when it returns to its outwardly extended position, engages the shackle. The lock is generally locked by means of a key, which is passed into the lock through a keyhold in the spring-loaded element.

Locking of such a plug type lock by means of a key has the disadvantage that the relatively small key cannot always be securely gripped, and is frequently lost or misplaced.

It is, therefore, a primary object of the present invention to provide a plug type lock for briefcases, purses, etc. which may be locked without the necessity of a key.

The above object, as well as others which will hereinafter become apparent, is accomplished by providing a lock of the above-described type wherein a locking mechanism is disposed in the upper portion of the lock within the region of the spring-loaded element. The locking mechanism is actuated by at least one and preferably two, combination wheels bearing numerals, which effect locking of the lock. Such a locking mechanism is generally referred to as a combination lock wherein the correct combination of numbers permits unlocking of the mechanism.

The use of combination locks in such articles as suitcases, attache' cases, etc. is well known. Such combination locks consist of a rigid lock portion in which the combination wheels are disposed, and generally of a plug-in hasp provided with a hook which, for example, is pivotally mounted on the cover of the suitcase.

The present invention will be described and understood more readily when considered together with the embodiment shown in the accompanying drawing, in which:

FIG. 1 is a plan view of a plug type lock of the present invention, in the locked position;

FIG. 2 is a plan view of the upper portion of the plug type lock of the present invention;

FIG. 3 is a side view of the upper portion of the plug type lock of the present invention;

FIG. 4 is a plan view of the lower portion of the plug type lock of the present invention; and FIG. 5 is a side view of the lower portion of the plug type lock of the present invention.

As can be seen in the figures of the drawing, the plug type lock of the present invention consists of an upper portion, generally designated 1, which may, for example, be attached by means of clamps, designated 2, to the flap of a briefcase, and of a lower portion, designated 3, which may also be attached by means of clamps 2 to a corresponding opposite location on the briefcase. Lower portion 3 includes a generally U-shaped shackle, designated 4, which slidingly receives upper portion 1 during closure of the plug type lock. During closure, the outwardly-biased, spring-loaded element, designated 5, in the lower region 8 of upper portion 1 is collapsed against the biasing action of the spring loading by shackle 4, and then is released to its upward position once clear of shackle 4. In this position, shackle 4 is constrained or engaged between element 5 and the raised rib, designated 9, in the upper region 10 of upper portion 10, thus effecting closure of the lock. In order to open the lock, spring-loaded element 5 must be depressed, thereby releasing the constraint on shackle 4, and upper portion 1 of the lock slidingly withdrawn therefrom. Element 5 may be formed as a reflector for the purpose of identification.

According to the invention, there is disposed in lower region 8 of upper portion 1, within the region of spring-loaded element 5, a locking mechanism, designated 11 and graphically shown, which is actuated by at least two adjustable combination wheels, designated 6 and 7, bearing combination numerals. The number combination of the combination wheels is freely selectable. Spring-loaded element 5 can only be depressed against the biasing action of the spring loading, if the previously set number combination is correctly chosen.

Both combination wheels 6 and 7 are disposed, in the illustrated embodiment, in the lower region 8 of upper portion 1, and project somewhat from the lower side so that they may be easily manipulated. These combination wheels can also be provided in the upper region 10 of upper portion 1 of the lock projecting laterally therefrom, and wherein the number of combination wheels can vary from 1 to 4, depending on the embodiment of the locking mechanism 11.

Choice of the number combination is accomplished by the lock being delivered from the factory with the combination "00" for the two wheels. The combination wheels are first set to this combination and spring-loaded element 5 is depressed. Simultaneously, a new combination may be set by rotation of the wheels. The combination wheels must be displaced from the set combination in order to lock the lock. The choice of the number combination can be selected and changed at an arbitrary frequency.

It is understood that the foregoing general and detailed descriptions are explanatory of the present invention and are not to be interpreted as restrictive of the scope of the following claims.

What is claimed is:

1. A plug type lock for briefcases and the like comprising a substantially planar upper portion attached to a flap of the briefcase having a raised rib in the upper part thereof extending above the plane defined by said upper portion and an element in the lower part thereof outwardly-biased to extend above the plane defined by said upper portion, a lower portion disposed on the corresponding opposite part of the briefcase having a shackle which slidingly receives the upper portion and engages the outwardly-biased element of the upper portion during closure of the lock so as to be closely received between said outwardly-biased element and said raised rib, and a locking mechanism disposed in said upper portion within the region of said outwardly-biased element to lock said element in the outwardly-biased position, said locking mechanism being actuated by at least one combination wheel to effect locking of said lock, said at least one combination wheel being arranged substantially parallel to the plane defined by said upper portion.

2. The plug type lock according to claim 1, wherein locking is effected by two combination wheels protruding from the lower side of said lock upper portion.

3. The plug type lock according to claim 1, wherein said at least one combination wheel protrudes from the lower side of said upper portion of said lock.

4. The plug type lock according to claim 1, wherein said outwardly-biased element is formed as a reflector.

* * * * *